United States Patent [19]

Tanaka et al.

[11] Patent Number: 4,735,576

[45] Date of Patent: Apr. 5, 1988

[54] SURFACE-MOUNTING WIRING DEVICE

[75] Inventors: Sadamasa Tanaka, Tsu; Masuo Kitamura, Kadoma, both of Japan

[73] Assignee: Matsushita Electric Works, Ltd., Japan

[21] Appl. No.: 878,255

[22] Filed: Jun. 25, 1986

[30] Foreign Application Priority Data

Jun. 25, 1985 [JP] Japan ..... 60-138545

[51] Int. Cl.[4] ..... H01R 4/66; H01R 13/506

[52] U.S. Cl. ..... 439/92; 439/686

[58] Field of Search ..... 335/14 R, 191 R, 191 M, 335/191 S, 192 R, 125 R; 439/92, 571, 682, 686

[56] References Cited

U.S. PATENT DOCUMENTS 3,707,697 12/1972 Izumi ..... 339/14 R

*Primary Examiner*—Eugene F. Desmond

*Attorney, Agent, or Firm*—Stevens, Davis, Miller & Mosher

[57] ABSTRACT

Surface-mounting wiring device wherein a cover assembly mounted on a base carrying terminal members for covering them has a double structure of an inner cover and an outer decorative cover, the inner cover facing directly toward the terminal members is heat resistant, and the decorative cover exchangeably fitted over the inner cover is impact resistant, whereby the two conditions of heat and impact resistance are simultaneously satisfied, while the exchangeable decorative cover allows the device to have any desired appearance.

10 Claims, 4 Drawing Sheets

SURFACE-MOUNTING WIRING DEVICE

TECHNICAL BACKGROUND OF THE INVENTION

This invention relates to surface-mounting wiring devices and, more specifically, to thin and surface-mounting type receptacles or the like wiring devices having plug-blade receiving metal fittings.

The surface-mounting wiring devices of the type referred to are so arranged that the plug-blade receiving fittings are connectable to a power supply line for supplying electric power to electrical equipment attachment plug blades which are inserted into the plug-blade receiving fittings, and find their usefulness when employed in particular as an alternative receptacle for any already mounted receptacle because they can be mounted directly against a wall surface or the like.

DISCLOSURE OF PRIOR ART

Disclosed in Japanese Utility Model Publication No. 55-21498 is an example of such surface-mounting type wiring devices, in which a pair of plug-blade receiving fittings are disposed symmetrically on a base, terminal screws are screwed to the fittings for connecting them to ends of a power supply line, and a cover having openings for insertion of plug blades therethrough into engagement with the fittings is mounted over the base.

In the wiring device of such an arrangement, the base and cover are made of thermosetting resin to be heat resistant. However, such wiring devices have had a problem that, while the cover made specifically of thermosetting resin can be effectively prevented from being thermally deformed due to arc heat generated upon separation of the plug blades from the blade receiving fittings, the cover is caused to be easily cracked by an application of a mechanical impact to have such electrically conductive members as the blade receiving fittings exposed.

Further, there has been involved in the known device of this type another problem in an unfavorable appearance due to a frequent provision of usually exposing the base and cover, in which case a connecting part of the earthing terminal with a grounding wire is also exposed outside.

In the wiring device of the type referred to, further, the cover is provided with ribs which project from the inner wall of the cover to be in close proximity to the blade receiving fittings to prevent opposing a pair of blade-holding legs of the fittings from being left excessively separated from each other after frequent insertion of the plug-blades to avoid any contact failure between the blade-holding legs and the plug blades. In this case, however, these ribs have to be in above-and-below relation to the terminal screws screwed to the blade receiving fittings in thickness direction of the wiring device, and this has been hindering the realization of a thinner wiring device.

TECHNICAL FIELD OF THE INVENTION

A primary object of the present invention is, therefore, to provide a wiring device in which a cover is excellent in resistance to both heat and impact.

The present invention is to further provide a wiring device which has eliminated simultaneously the various problems, in such that the connection of the earthing terminal to a grounding wire is achieved in the interior of the wiring device to provide an excellent appearance, the terminal screws and ribs for preventing excessive separation at the blade-holding leg portions of the plug-blade receiving fittings are arranged side by side but without expanding in planar space so as to effectively realize a thinner wiring device.

According to the present invention, the above objects can be realized by providing a wiring device which comprises a base, terminal members mounted on the base and including conductive metal fittings for receiving blades of attachment plugs and terminal screws, and a cover assembly including an inner cover made of a heat resistant plastic resin and a decorative outer cover of an impact resistant plastic resin, the cover assembly being coveringly mounted on the base and having openings for insertion therethrough of the plug blades into engagement with the blade receiving fittings.

Other objects and advantages of the present invention shall become clear from the following description of the invention detailed with reference to preferred embodiments shown in accompanying drawings.

Figure 1:
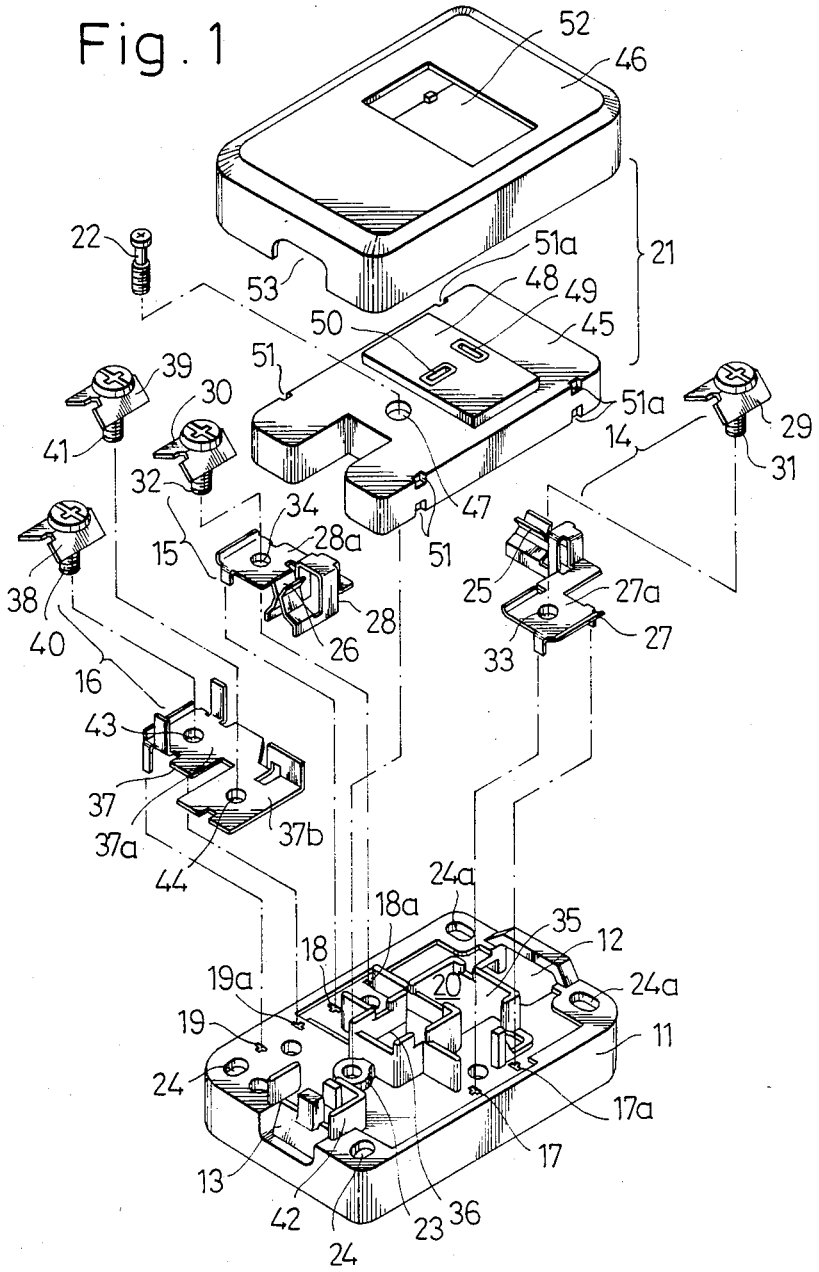
FIG. 1 is an exploded perspective view of a wiring device in an embodiment according to the present invention.
Figure 3:
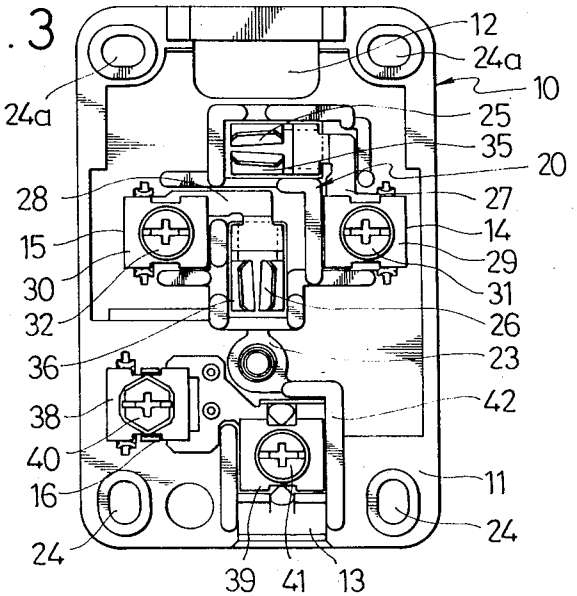
FIG. 3 is an interior plan view of the wiring device of FIG. 1 assembled but with the cover assembly removed.
Figure 2:
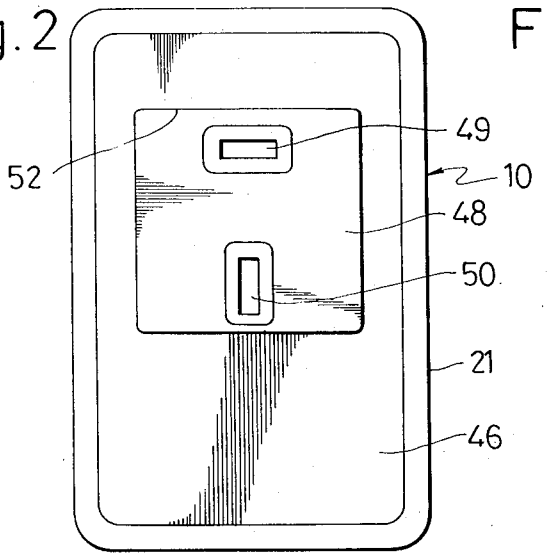
FIG. 2 is a top plan view of the wiring device of FIG. 1 as assembled.
Figure 4:
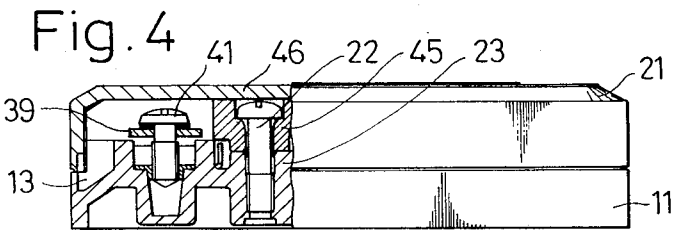
FIG. 4 is a side view of the wiring device of FIG. 1 assembled, but partly in section taken particularly along an earthing terminal section.
Figure 5:
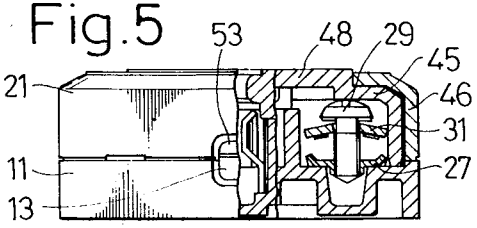
FIG. 5 is a front end view of the wiring device of FIG. 1 assembled, but partly in section taken particularly along one of the terminal members.
Figure 6:
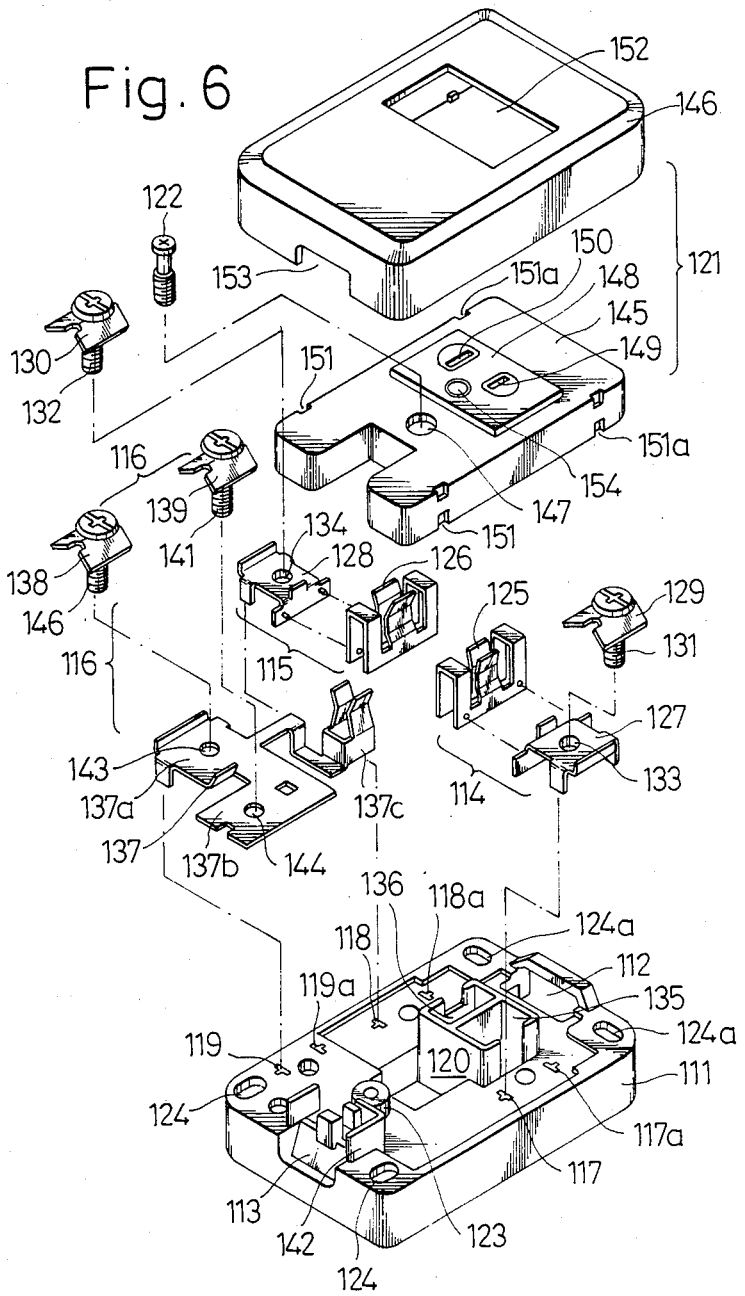
FIG. 6 is an exploded perspective view of a wiring device in another embodiment according to the present invention.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Referring to FIGS. 1 to 5, a surface-mounting wiring device 10 according to the present invention comprises a base 11 made preferably of a thermosetting plastic to have a heat resistance. The base 11 is provided in one longitudinal end with an inlet 12 through which an end of a power supply line (not shown) is inserted, and in the other longitudinal end with a notch 13 through which an end of an earthing wire (not shown) is inserted. Further, the base 11 is provided in its top wall with three pairs of engaging holes 17 and 17*a*, 18 and 18*a*, and 19 and 19*a* for positioning as engaged therein two sets of terminal member 14 and 15 and an earthing terminal member 16 (which members will be detailed later) respectively, and with upright insulating walls 20 to electrically isolate the respective terminal members engaged in the holes from each other. In the present embodiment, a coupling boss 23 for driving thereinto a screw 22 to secure a later detailed cover assembly 21 is provided on the top face of the base 11 at a position between the insulating walls 20 and other end having the notch 13. Also in the top face of the base 11, two pairs of holes 24 and 24*a* are made respectively at both side corners adjacent the both longitudinal ends, for mounting the base to a surface of a wall, pillar or the like of a house or building by means of screws fastened through these holes into the surface.

The terminal members 14 and 15 forming a pair comprise respectively a terminal metal fitting 27 or 28 having opposing resilient legs 25 or 26 for receiving and holding between them each blade of attaching plug (not shown) of an electric equipment, and terminal screw 31 or 32 having a washer 29 or 30. The terminal screws 31 and 32 are provided to be screwedly inserted into screw holes 33 and 34 formed in body portions 27*a* and 28*a* of the terminal fittings 27 and 28 respectively, so that exposed conductor ends of the power supply line guided through the inlet 12 of the base 11 can be fixedly held between the body portions 27*a* and 28*a* and the washers 29 and 30 of the terminal fittings 27 and 28, respectively. The plug-blade receiving legs 25 of the terminal member 14 is provided to receive one of the plug blades which is disposed to expand in the width direction of the base 11 within a partition chamber 35 defined by the insulating walls 20, while the plug-blade receiving legs 26 of the other terminal member 15 are provided to receive the other plug blade expanded in the longitudinal direction of the base 11 within another partition chamber 36 defined by the insulating walls 20.

The earthing terminal member 16 comprises a terminal metal fitting 37 and two terminal screws 40 and 41 respectively having washers 38 and 39. The terminal fitting 37 is formed to have a half portion 37*a* to be engaged at its downward extended legs in the holes 19 and 19*a* of the base 11 and the other half portion 37*b* to be seated on the base as guided by a wall 42 erected adjacent the notch 13, while the two half portions 37*a* and 37*b* are formed integral, and the terminal screws 40 and 41 are screwed into respective holes 43 and 44 provided in the half portions 37*a* and 37*b* for holding earthing wire ends.

The cover assembly 21 has a double structure comprising an inner cover 45 and an outer decorative cover 46, the inner cover 45 being made of a thermosetting plastic to have a heat resistance and the decorative cover 46 being of a thermoplastic resin to have an impact resistance. The inner cover 45 is formed to be seated on the base 11, accommodating the insulating walls 20, except a part including the notch 13 and its vicinity inside the other end of the base 11. That is, by inserting the screw 22 into a hole 47 provided in the inner cover 45 and aligned with the coupling boss 23 of the base 11, and then screwing the screw 22 into the projection 23, the inner cover 45 can be firmly secured to the base 11. Further, the inner cover 45 is provided in the top wall with an upwardly-raised rectangular box portion 48 at a position above the terminal members 14 and 15, and this box portion 48 is formed to have a first plug-in opening 49 extended in the width direction of the base 11 at a position right above the plug-blade receiving legs 25 of the terminal member 14, and a second plug-in opening 50 extended in the longitudinal direction of the base 11 to be right above the plug-blade receiving legs 26 of the other terminal member 15.

The outer decorative cover 46 is formed to have inward projected nails (only one is seen in FIG. 1) for snap engagement into notches 51 and 51*a* made in side wall edges of the inner cover 45. Accordingly, the decorative cover 46 can be disengageably fitted over the inner cover 45 by means of the snap engagement of the nails into the notches 51 and 51*a*, while abutting at lower peripheral edges against the base 11. The decorative cover 46 has in its top face an opening 52 to expose thereout the box portion 48 of the inner cover 45, and in an end wall a notch 53 at a position corresponding to the notch 13 of the base 11. In this case, in addition to an advantage of the decorative cover 46 in the impact resistance, the present invention provides another advantage that the design of the wiring device can be readily refreshed by disengaging the decorative cover 46 to exchange it with a new one of variously designed decorative covers previously prepared.

Brief explanation will be made as to assembling work and functions of the wiring device 10 of FIGS. 1 to 5. First, the terminal fittings 27 and 28 are engagingly fitted at their downwardly extended lugs into the holes 17, 17*a*, 18 and 18*a* in the top wall of the base 11 to be seated thereon, and the plug-blade receiving legs 25 and 26 of the terminal fittings 27 and 28 are located within the parition chambers 35 and 36 defined by the insulating walls 20, respectively. Then, the terminal screws 31 and 32 with the washers 29 and 30 are driven into the holes 33 and 34 of the terminal fittings 27 and 28, whereby the terminal members 14 and 15 are mounted on the base 11 with the two pairs of the plug-blade receiving legs 25 and 26 oriented in mutually different directions, that is, in the width and longitudinal directions of the base 11. Next, the terminal fitting 37 of the earthing terminal member 16 is engagedly fitted at its downwardly extended lugs into the holes 19 and 19*a* provided in the top wall of the base 11 so that the half portions 37*a* and 37*b* of the terminal fitting 37 will be seated on the base 11 while guiding the half portion 37*b* along the wall portion 42. Subsequently, the terminal screws 40 and 41 with the washers 38 and 39 are driven into the holes 43 and 44 of the half portions 37*a* and 37*b*, and thus the earthing terminal member 16 is mounted on the base 11 with the half portion 37*b* of the terminal fitting 37 facing internally the notch 13 of the base 11.

Driving four fixing screws, through the corner holes 24 and 24*a* of the base 11 carrying thereon the terminal members 14 and 15 and the earthing terminal member 16, into to wall or pillar surface, the base 11 can be fixedly mounted on the surface. A pair of exposed conductor ends of the power supply line are guided into the inlet 12 of the base 11 and led to the terminal members 14, 15 and 16, where the conductor ends respectively separated and looped in a known manner are placed on the respective body portions 27*a* and 28*a* of the terminal fittings 27 and 28, and then the terminal screws 31 and 32 passed through the looped conductor ends are fastened into the holes 33 and 34, whereby the conductor ends of the power supply line can be fixedly held between the body portions 27*a* and 28*a* of the terminal fittings 27 and 28 and the washers 29 and 30 of the terminal screws 31 and 32 to connect the power supply line to the terminal parts 14 and 15. On the other hand, an exposed conductor end of the earth level line in placed on the half portion 37*a* of the terminal member 16, and the terminal screw 40 is fastened to the screw hole 43 for connecting the earthing line to the member 16. A grounding wire for an electrical equipment is introduced through the notch 13 over to the half portion 37*b* of the earthing terminal member 16, and then the terminal screw 41 is screwed into the hole 44, to connect the grounding wire to the earth level line through the terminal fitting 37 on the top surface of the base 11.

Now, by mounting the inner cover 45 of the cover assembly 21 on the base 11 incorporating the terminal parts 14, 15 and 16 and fastening the coupling screw 22 through the hole 47 of the cover 45 into the boss 23 of the base 11, the inner cover 45 can be fixed to the base 11. The outer decorative cover 46 is then fitted over the inner cover 45 on the base 11, and is secured thereto with the nails engaged in the notches 51 and 51*a* of the inner cover 45 to enclose the inner cover 45, and thus the assembling of the wiring device 10 is completed. When the attachment plug blades of the electric equipment are inserted into the plug-in openings 49 and 50 in the box portion 48 of the inner cover 45 of the thus completed wiring device 10, the blades come into contact with the blade receiving legs 25 and 26 as held between them, and an electric path is completed between the power supply line and the electric equipment.

In the wiring device arranged as has been described above according to the present invention, the double structure of the cover assembly 21 in which the inner cover 45 facing the terminal members 14, 15 and 16 on the base 11 as well as the outer decorative cover 46 fitted over the inner cover 45 are respectively made of the thermosetting and thermoplastic resins can concurrently satisfy both the heat and impact resistance. Further, merely by exchanging the decorative cover 46, there can be easily provided a wiring device of another appearance in the various designs made available, while using the same constituent parts.

Since the earthing wire can be connected to the earthing terminal member within the wiring device without exposing their connecting part to the exterior, further, the favorable appearance of the wiring device according to the present invention can be retained.

Referring to FIGS. 6 to 9, there is shown a surface-mounting wiring fitting 100 in another embodiment of the present invention, in which constituent members substantially equivalent to those in the embodiment of FIGS. 1 to 5 are denoted by the same reference numerals but added by 100. The present embodiment shares commonly the same and unique technical matters as the foregoing embodiment, but is different therefrom in practical arrangement as will be detailed in the followings. First, the terminal members 114 and 115 comprise plug-blade receiving legs 125 and 126, terminal metal fittings 127 and 128 formed separately from the legs but coupled thereto integrally by engaging pins of the fittings into opposing holes in the legs, and terminal screws 131 and 132 having washers 129 and 130. In addition, the plug-blade receiving legs 125 and 126 are located not in mutually different directions as in the foregoing embodiment but in mutually parallel relationship, in the longitudinal direction of the base 111. In this connection, partition chambers 135 and 136 defined by insulating walls 120 on the top face of the base are arranged side by side in the width direction of the base 111 to accommodate the respective plug-blade receiving legs 125 and 126, while plug-in openings 149 and 150 formed in a box portion 148 of the inner cover 145 are arranged parallelly in the longitudinal direction of the base 111 as positioned right above the plug-blade receiving legs 125 and 126.

In the present embodiment, further, a terminal metal fitting 137 of an earthing terminal member 116 is integrally provided with a blade receiving part 137*c* extended to the vicinity of the insulating walls 120 defining the partition chambers 135 and 136. The box portion 148 of the inner cover 145 is formed to have an insertion hole 154 along with the plug-in openings 149 and 150, which hole 154 is positioned right above the blade receiving part 137*c*. A coupling boss 123 into which a screw 122 passed through a hole 147 in the inner cover 145 is to be screwed is provided between the blade receiving part 137*c* of the earthing terminal member 116 and a notch 113 made in longitudinally front end wall of the base 111, independently of the insulating walls 120.

Figure 8:
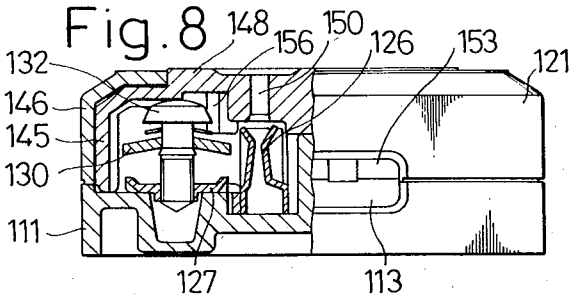
FIG. 8 is a front end view of the wiring device of FIG. 6 assembled but partly in section for showing in particular positional relation between one of the terminal members and one of leg-separation preventing ribs.
Figure 9:
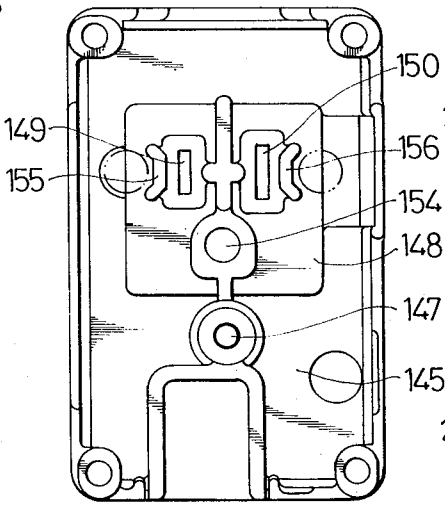
FIG. 9 is a bottom plan view of a cover assembly in the wiring device of FIG. 6.
Figure 7:
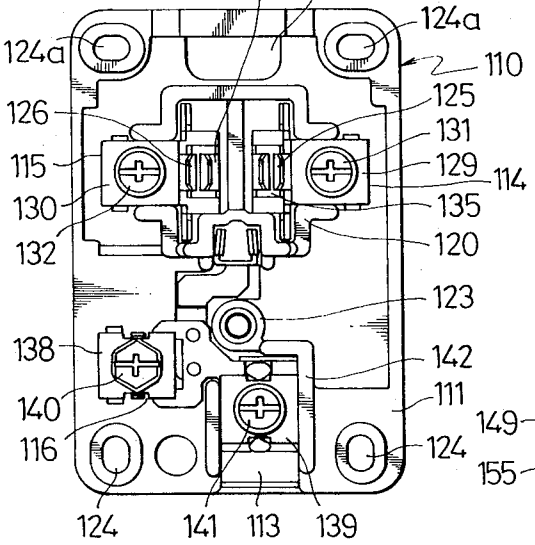
FIG. 7 is an interior plan view of the wiring fitting of FIG. 6 as assembled but with a cover assembly removed.

According to a remarkable feature of the present embodiment, the inner cover 145 is provided on the inner top wall face with downward projected ribs 155 and 156 for preventing the opposing pair of resilient legs in the respective plug-blade receiving legs 125 and 126 from being left as excessively separated from each other after repetitive use (see FIGS. 8 and 9). Thus, the ribs 155 and 156 are provided inside the box portion 148 of the inner cover 145 in close proximity to the plug-in openings 149 and 150, substantially as C-shaped as viewed from the bottom to position their middle part directed toward the plug-in openings 149 and 150 but their end portions away from the openings.

In the present embodiment of such arrangement as above, therefore, an insertion of the plug blades into the plug-blade receiving legs 125 and 126 is made while the ribs 155 and 156 are preventing the opposing blade-holding portions of the plug-blade receiving legs 125 and 126 from being excessively opened. In this case, in particular, the C-shaped formation of the ribs 155 and 156 is effective not to hinder the fastening of the terminal screws 131 and 132 to the terminal fittings 127 and 128, and the ribs 155 and 156 and terminal screws 131 and 132 can be arranged side by side in the width direction of the base 111 without substantially increasing the width dimension of the base 111. As a result, the ribs 155 and 156 and terminal screws 131 and 132 are no longer required to be arranged in vertical relationship as in the known devices, and thus the wiring device of the present invention can be made effectively thin.

According to the present embodiment, an earth level line is guided through the notch 113 and preliminarily connected to a half portion 137*b* of the earthing terminal member 137 located in the vicinity of the notch 113, and then an end of a grounding wire for the electrical equipment or the like is inserted through the hole 154 of the inner cover 145 into a position of being held by the blade receiving part 137*c* of the earthing terminal member 116, whereby the grounding wire can be connected to the earth level line. In this manner, the earthing work of the electric equipment or the like can be highly easily conducted.

Other arrangement and function of the wiring fitting of FIGS. 6 to 9 are substantially the same as those in the embodiment of FIGS. 1 to 5.

Figure 10:
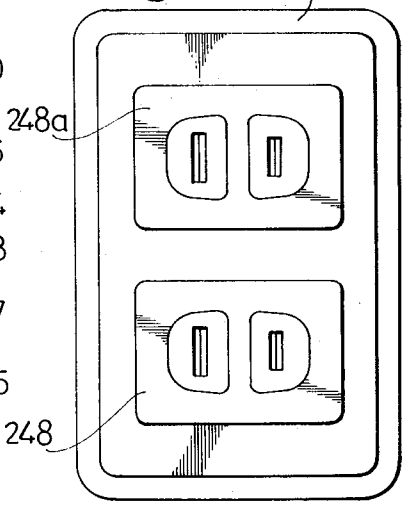
FIG. 10 is a top plan view of an inner cover shown as an example of other arrangements of the terminal members possible in the wiring device according to the present invention.

Further, the surface-mounting wiring device of the present invention may be modified in various ways. For example, as shown in FIG. 10, the inner cover of a cover assembly 221 may be formed to have two box portions 248 and 248*a* having respectively a pair of plug-in openings. In this case, it will be appreciated that two pairs of terminal members having two pairs of plug-blade receiving legs are arranged in parallel on the base. Other arrangement of this wiring device of FIG. 10 may be substantially the same as that of the embodiment of FIGS. 6 to 9.

The excessive-leg-separation preventing ribs in the embodiment of FIGS. 6 to 9 can be employed in the embodiment of FIGS. 1 to 5 in substantially the same manner by providing the ribs in close proximity to the plug-in openings for insertion of plug blades. Further, the earthing terminal members of FIGS. 6 to 9 may be replaced by those in the embodiment of FIGS. 1 to 5.

What is claimed as our invention is:

1. A surface-mounting wiring device comprising a base to be secured to a wall surface or the like, at least a pair of terminal members mounted on said terminal members having a fitting for receiving and holding each of at least two plug blades so as to be insulated from each other and at least two terminal screws for connection to said power supply line, and a cover assembly provided to cover said base including said terminal members mounted thereon, said cover assembly including an inner cover of heat resistant material which is mounted over said base and detachably secured thereto, and an outer decorative cover of impact resistant material covering said inner cover and detachably secured thereto by means of interfitting projections and notches on one of said covers mating with similar projections or notches on the other of said covers, said inner cover being provided with plug-in openings for insertion of said plug blades at positions corresponding to said blade receiving fittings of said terminal members, and said outer decorative cover allowing only a part including said plug-in openings of said inner cover to be exposed to the exterior.

2. A wiring device according to claim 1, wherein said inner cover of said cover assembly is made of a thermosetting plastic resin, and said decorative cover is made of a thermoplastic resin.

3. A wiring device according to claim 2, wherein an area of said inner cover facing at least said plug-blade receiving fittings is formed in an outwardly-extruded box portion having said plug-in openings, and said decorative cover is provided with an opening through which said box portion of the inner cover is exposed to the exterior.

4. A wiring device according to claim 1, which further comprises an earthing terminal member, and in which said base is provided at one end portion with a notch, said earthing terminal member being mounted onto said base in close proximity at least partly to said notch to be covered by said cover assembly.

5. A wiring device according to claim 4, wherein said earthing terminal member has a terminal fitting located partly to said end portion of said base and a terminal screw fastened to said terminal fitting.

6. A wiring device according to claim 5, wherein said terminal fitting of said earthing terminal member has an integral blade receiving part, and said cover assembly is provided with a hole for inserting therethrough a grounding wire end into said blade receiving part of the earthing terminal member.

7. A wiring device according to claim 6, wherein an area of said inner cover facing at least said plug-blade receiving fittings of said pair of terminal members and said blade receiving part of said earthing terminal member is formed as an outwardly-extruded box portion having parallel plug-in openings for insertion of said plug blades and a hole for insertion of said grounding wire end, and said decorative cover is provided with an opening through which said box portion is exposed to the exterior.

8. A wiring fitting according to claim 1, wherein said inner cover is provided with ribs projected inward from an inner surface of said inner cover at positions in close proximity to said plug-in openings, said ribs being disposed to be in side by side relation to said terminal screws of said pair of terminal members on said base in a direction perpendicular to the thickness direction of the base for preventing opposing leg portions of said plug-blade receiving fittings of the terminal members from being left as excessively separated.

9. A wiring device according to claim 8, wherein said leg-separation preventing ribs are shaped as bent at their middle portion toward said plug-in opening but at their end portions away from the openings.

10. A wiring device according to claim 9, wherein said leg-separation preventing ribs are respectively substantially C-shaped as viewed endwise.

* * * * *